US006564851B1

(12) United States Patent
Liao

(10) Patent No.: US 6,564,851 B1
(45) Date of Patent: May 20, 2003

(54) DETACHABLE DRAPERY HANGER ASSEMBLY FOR EMERGENCY USE

(76) Inventor: Yu Hua Liao, 7F, No. 46, Pin Ho 10 Street, Chang Hua (TW), 500

( * ) Notice: Subject to any disclaimer, the term of this patent is extended or adjusted under 35 U.S.C. 154(b) by 0 days.

(21) Appl. No.: 10/000,166

(22) Filed: Dec. 4, 2001

(51) Int. Cl.[7] ..... A47H 1/00
(52) U.S. Cl. ..... 160/330; 16/87.4 R
(58) Field of Search ..... 160/330, 340, 160/344, 345, 168.1 V, 173 V, 341; 16/87.2, 87.4 R, 94 D, 95 D, 96 D

(56) References Cited

U.S. PATENT DOCUMENTS 1,975,000 A * 9/1934 Beaumont et al. ..... 16/87.2 X
2,074,928 A * 3/1937 Miller ..... 16/87.2
3,137,027 A * 6/1964 Birkle ..... 16/87.2
3,688,341 A * 9/1972 Peckham ..... 160/330 X
3,785,003 A * 1/1974 Thomson ..... 16/87.2
3,829,928 A 8/1974 Pizzurro ..... 16/87.2
3,997,944 A 12/1976 Phillips ..... 24/86
4,217,676 A 8/1980 Terrones ..... 16/87.2
4,304,174 A 12/1981 Hickson et al. ..... 98/33 A
4,607,678 A 8/1986 Pomaville et al. ..... 160/332
4,675,939 A * 6/1987 Fukada ..... 16/87.2
5,421,059 A * 6/1995 Leffers ..... 16/87.4 R

* cited by examiner

*Primary Examiner*—David Purol

(57) ABSTRACT

A drapery hanger includes one or more barrels attached to a track, and one or more blocks attached to a closure member and detachably securing to the barrel, for allowing the block to be quickly disengaged from the barrel when the block is forced and pulled away from the barrel. The blocks may be quickly pulled away from the track and the barrels by pulling the closure member, and the closure member may thus be quickly disengaged from the track, and may be wetted or dipped into water and may thus be engaged onto the users while in emergency condition, such as when on fire.

10 Claims, 8 Drawing Sheets

DETACHABLE DRAPERY HANGER ASSEMBLY FOR EMERGENCY USE

BACKGROUND OF THE INVENTION

1. Field of the Invention

The present invention relates to a drapery hanger, and more particularly to a drapery hanger assembly having one or more closure members detachable for emergency use.

2. Description of the Prior Art

Various kinds of typical drapery hangers have been developed for slidably or foldably holding closure members, such as draperies, curtains, foldable door panels, strips of curtain-like materials, plastic strips, etc. onto a top track or the like. For example, U.S. Pat. No. 3,829,928 to Pizzurro, U.S. Pat. No. 3,997,944 to Phillips. U.S. Pat. No. 4,217,676 to Terrones, U.S. Pat. No. 4,304,174 to Hickson et al., and U.S. Pat. No. 4,607,678 to Pomaville et al. disclose some of the typical drapery hangers and comprise one or more closure members slidably secured to a top track or the like with various kinds of hooks or the other fasteners. However, once the closure members have been attached or hooked to the top track with the hooks or the fasteners, the closure members may not be easily disengaged from the top track, unless the hooks or the fasteners are disengaged from the top track one by one. Particularly, when in emergency condition, such as when on fire, the closure members may not be quickly disengaged from the top track for emergency use.

The present invention has arisen to mitigate and/or obviate the afore-described disadvantages of the conventional drapery hangers.

SUMMARY OF THE INVENTION

The primary objective of the present invention is to provide a drapery hanger assembly including one or more closure members detachable for emergency use.

In accordance with one aspect of the invention, there is provided a drapery hanger assembly comprising a tracks at least one barrel attached to the track, a closure member, at least one block attached to the closure member, and means for detachably securing the block to the barrel, to disengage the block away from the barrel when the block forced and pulled away from the barrel. The blocks may be quickly pulled away from the track and the barrels by pulling the closure member, and the closure member may thus be quickly disengaged from the track, and may be wetted or dipped into water and may thus be engaged onto the users while in emergency condition, such as when on fire.

The detachably securing means includes a bore formed in the the barrel for detachably receiving the the block.

The detachably securing means includes an inclined inner peripheral surface provided in the the barrel for defining the bore of the the barrel, and includes an inclined outer peripheral surface provided on the the block for engaging with the inclined inner peripheral surface of the the barrel and for detachably retaining the the block in the bore of the the barrel.

The barrel includes a peripheral wall and includes a longitudinal groove formed in the peripheral wall for allowing the peripheral wall of the the barrel to be expanded.

The detachably securing means includes at least one peripheral recess provided in the the barrel and communicating with the bore of the the barrel, and includes at least one peripheral rib provided on the the block for engaging with the peripheral recess of the the barrel and for detachably retaining the the block in the bore of the the barrel.

The detachably securing means includes at least one peripheral rib provided in the the barrel, and includes at least one peripheral recess provided in the the block for engaging with the peripheral rib of the the barrel and for detachably retaining the the block in the bore of the the barrel.

The detachably securing means includes an inner thread provided in the the barrel, and includes an outer thread provided on the the block for engaging with the inner thread of the the barrel and for detachably retaining the the block in the bore of the the barrel.

The barrel includes a hook for attaching to the track. The barrel includes a seat provided thereon and having the hook secured thereon, the seat includes a lock notch provided therein, the hook includes a finger detachably secured into the lock notch of the seat. The track includes at least one sliding member slidably engaged therein and having a hook attached thereto for hooking to the hook of the barrel.

The block includes a hook for attaching to the track. The block includes a lock notch provided therein, the hook includes a finger detachably secured into the lock notch of the block.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
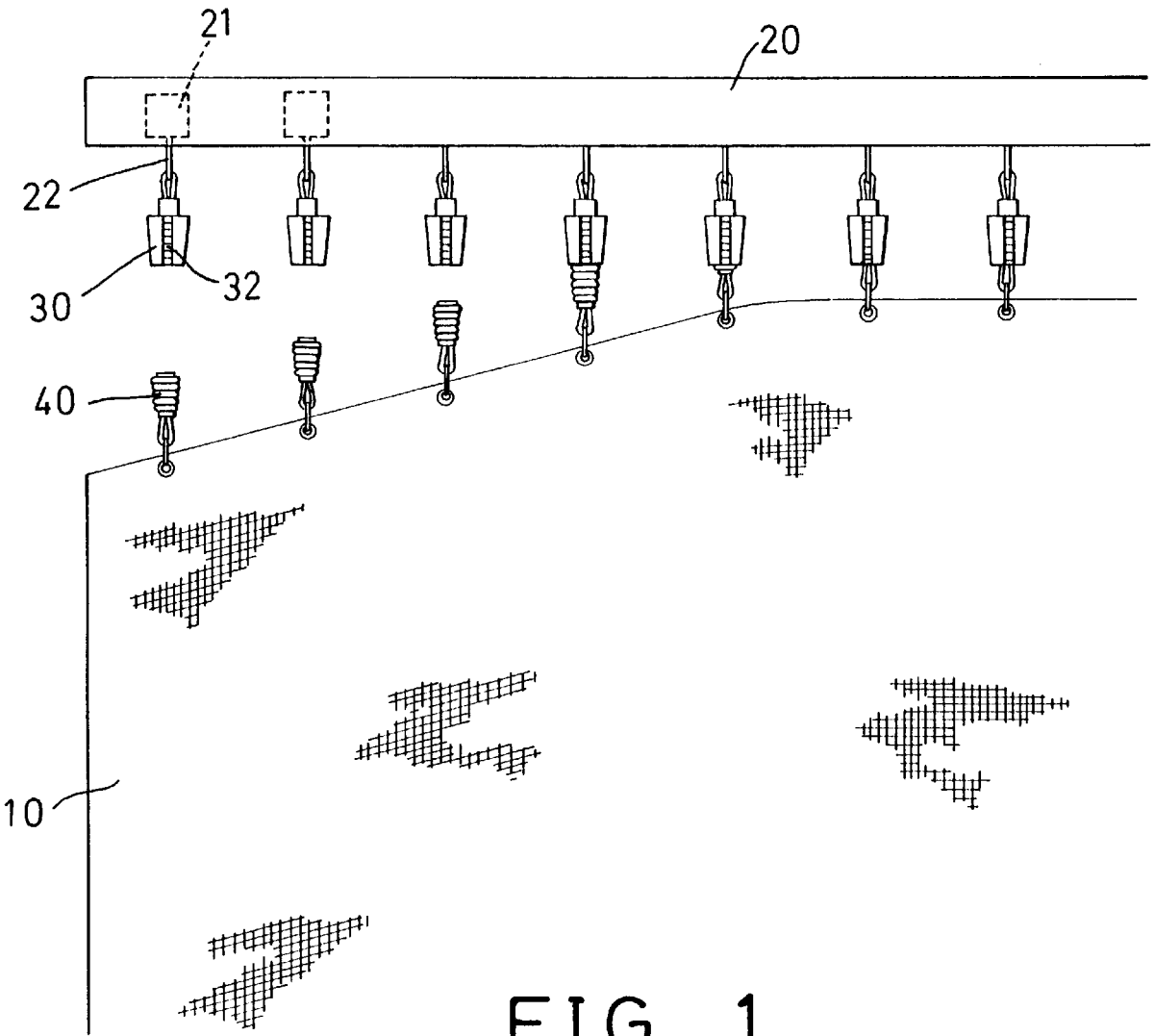
FIG. 1 is a plan schematic view illustrating the operation of a drapery hanger assembly in accordance with the present invention.
Figure 2:
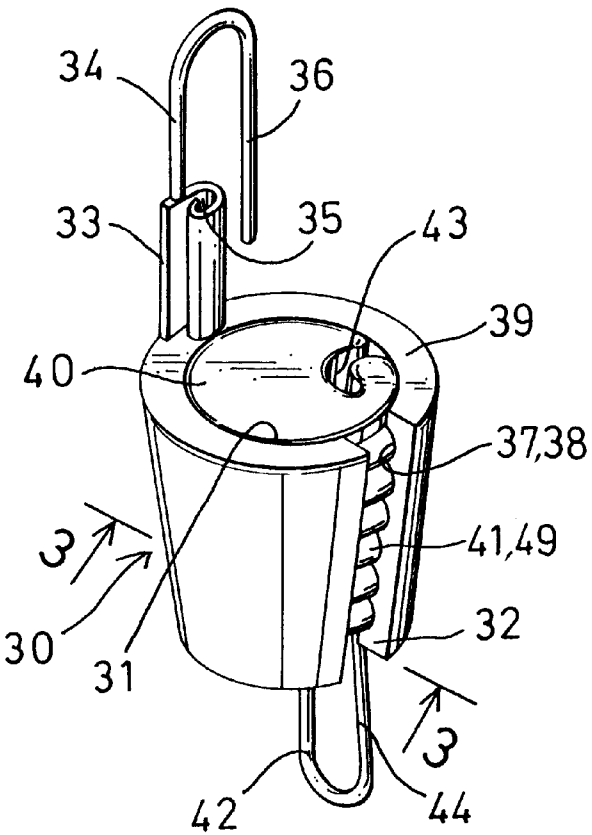
FIG. 2 is a perspective view of the drapery hanger assembly.
Figure 9:
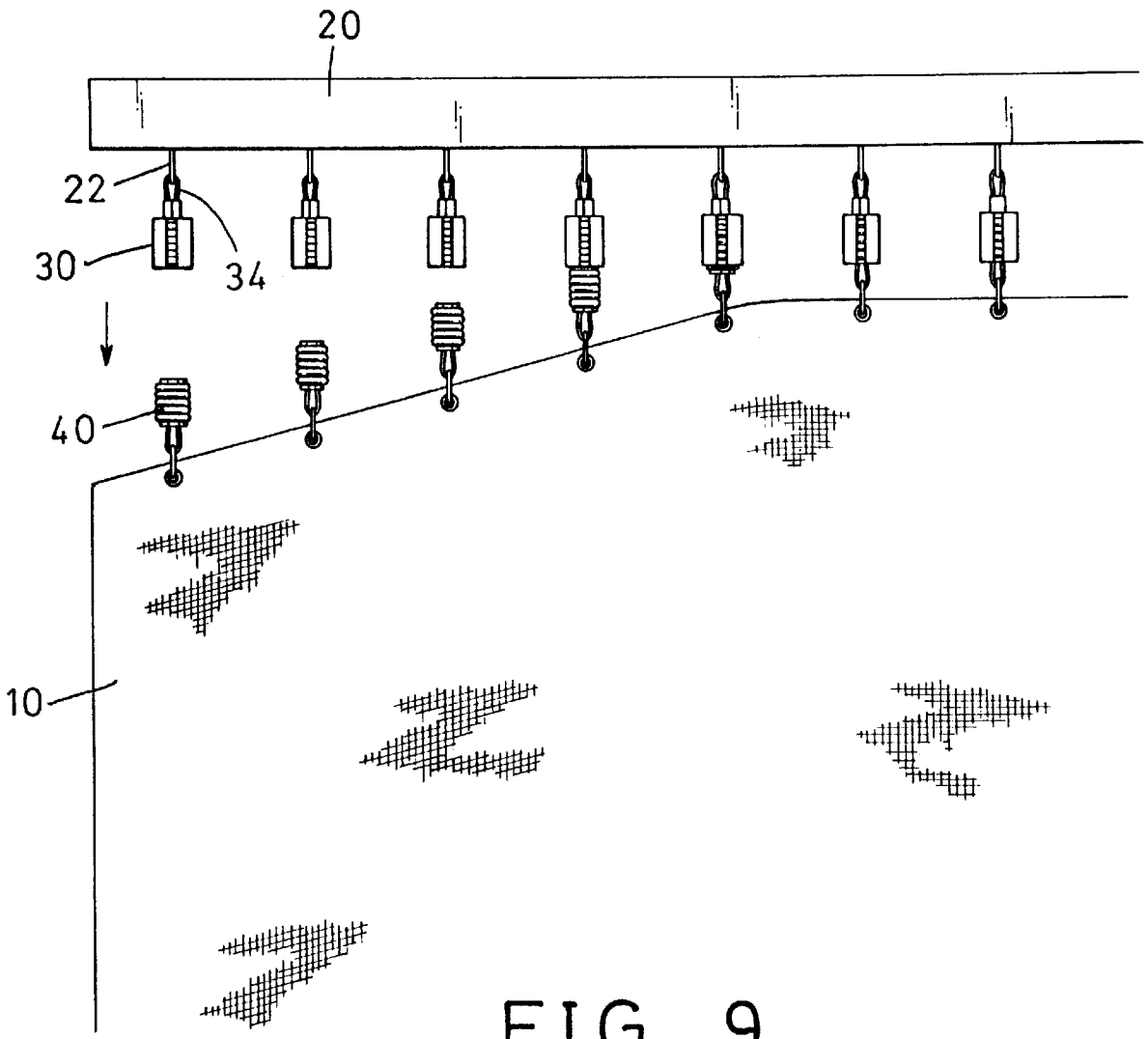
FIG. 9 is a plan schematic view illustrating the operation of the drapery hanger assembly as shown in FIGS. 6–8.
Figure 10:
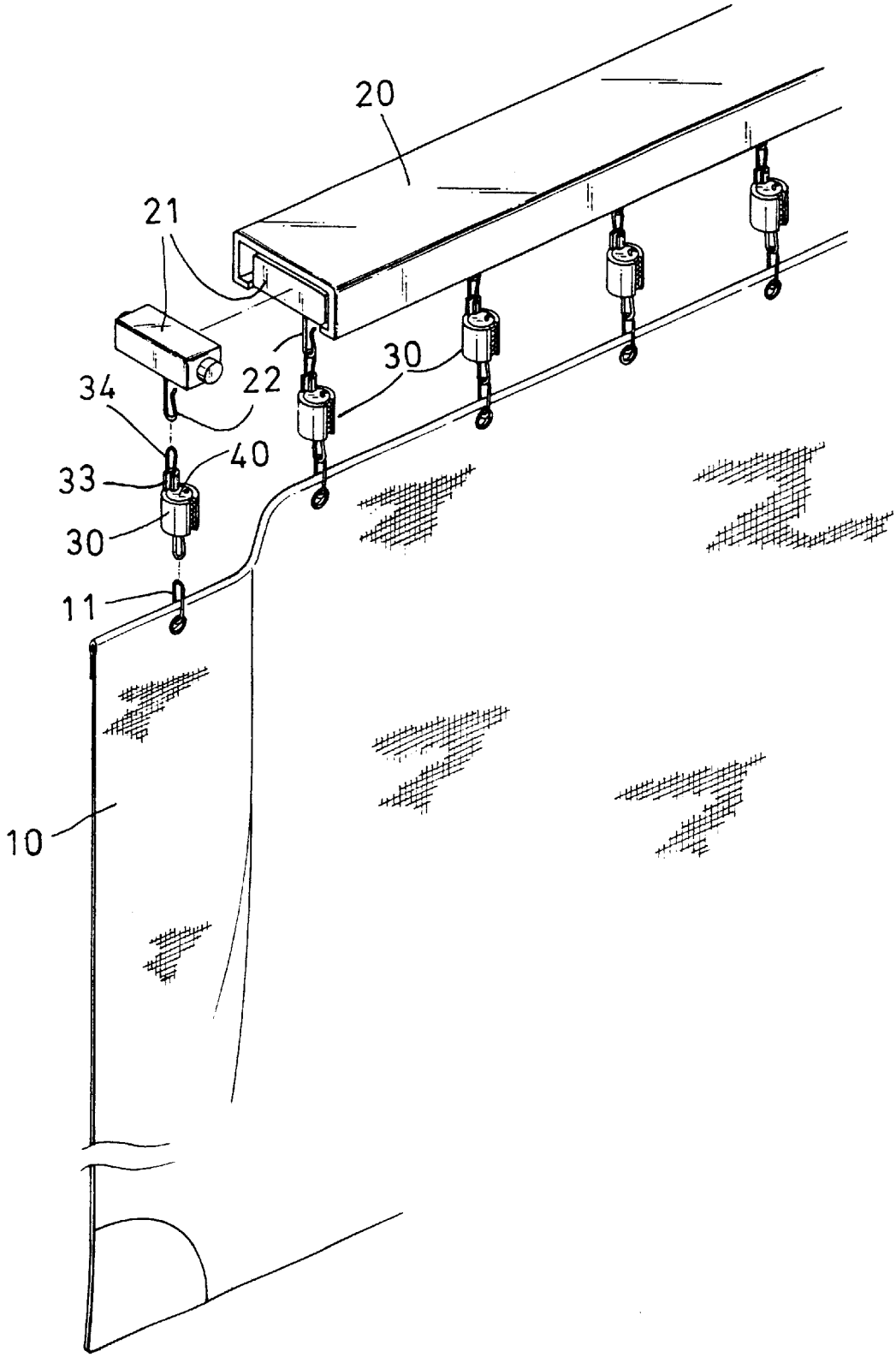
FIG. 10 is a partial exploded view illustrating the operation of the drapery hanger assembly as shown in FIGS. 6–8.

Referring to the drawings, and initially to FIGS. 1–4, a drapery hanger assembly in accordance with the present invention includes a drapery hanger device provided for slidably or foldably holding one or more closure members 10, such as draperies, curtains, foldable door panels, strips of curtain-like materials, plastic strips, etc. onto a top rail or track 20. For example, the drapery hanger assembly in accordance with the present invention includes one or more closure members 10 which may include a single sheet of curtain, drapery, door panel, strip, or the like as shown in FIGS. 1, 9, 10, and which may also include a number of curtains, draperies, door panels, strips, or the like each detachably attached to the top track 20 with a drapery hanger device of the drapery hanger assembly. A number of sliding elements 21 are slidably received in the track 20 and each includes a hook 22 or the like attached thereto for hooking to the drapery hanger device. The closure member 10 also includes one or more hook 11 or the like attached to the upper portion thereof for hooking to the drapery hanger device.

The drapery hanger device comprises a barrel 30 including a bore 31 formed therein, and formed or defined by an inner peripheral surface 37, for forming or defining a peripheral wall 39. The barrel 30 includes a longitudinal groove 32 formed in the peripheral wall 39 for forming a resilient peripheral wall 39, or for allowing the peripheral wall 39 to include a suitable resilience and to be expanded. The barrel 30 includes a seat 33 provided or extended from the upper portion thereof or disposed on the peripheral wall 39, and a hook 34 disposed on the seat 33 for directly hooking to the track 20, or hooking to the sliding elements 21, or to the hooks 22. The seat 33 includes a lock notch 35 formed or provided therein. The hook 34 includes a finger 36 for engaging or locking into the lock notch 35 of the seat 33 and for solidly and detachably locking the barrel 30 to the sliding element 21 of the track 20. The barrel 30 or the peripheral wall 39 of the barrel 30 preferably includes a frustum-shape having a frustum-shaped outer peripheral surface, and/or having a frustum-shaped or inclined inner peripheral surface 37, best shown in FIG. 3; and includes an inner thread 38 or one or more peripheral recesses or ribs 38 formed in the inner peripheral surface 37.

The drapery hanger device further includes a block 40 having a lock notch 43 formed or provided therein, and a hook 42 disposed or extended downward therefrom for directly hooking to the closure member 10, or to the hooks 11 of the closure members 10. The hook 42 includes a finger 44 for engaging or locking into the lock notch 43 of the block 40 and for solidly and detachably locking the block 40 to the sliding element 21 of the track 20. The block 40 preferably includes a frustum-shape having a frustum-shaped or inclined outer peripheral surface 41 and having an outer thread 49 or one or more peripheral ribs or recesses 49 formed in the outer peripheral surface 41 for threading to or engaging with the inner thread 38 or the recesses or ribs 38 of the barrel 30, and for detachably securing the block 40 in the barrel 30.

Figure 3:
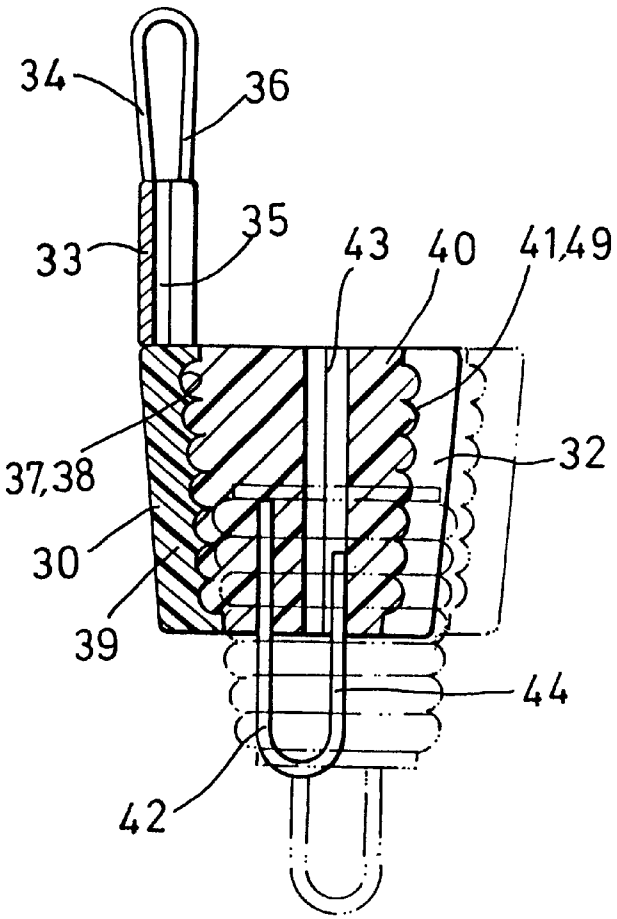
FIG. 3 is a cross sectional view taken along lines 3—3 of FIG. 2.
Figure 4:
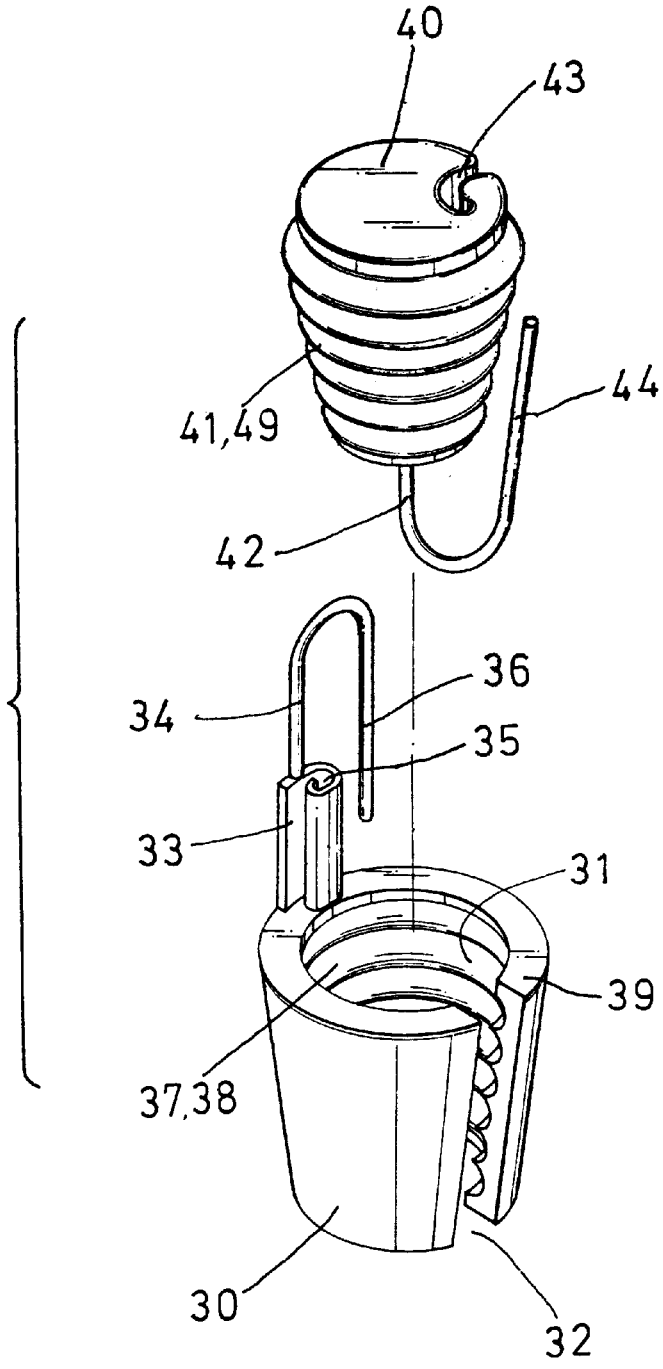
FIG. 4 is an exploded view of the drapery hanger assembly.

In operation, as shown in FIGS. 1 and 3, when the blocks 40 are pulled downward away from the track 20 and the barrels 30 by pulling the closure member 10, the peripheral wall 39 of the barrel 30 may be expanded by the block 40, and the block 40 may thus be pulled and forced downward relative to the barrel 30 and disengaged from the barrel 30, as shown in dotted lines in FIG. 3. The closure member 10 may thus be quickly disengaged from the track 20, and may be wetted or dipped into water and may thus be engaged onto the users while in emergency condition, such as when on fire.

Figure 5:
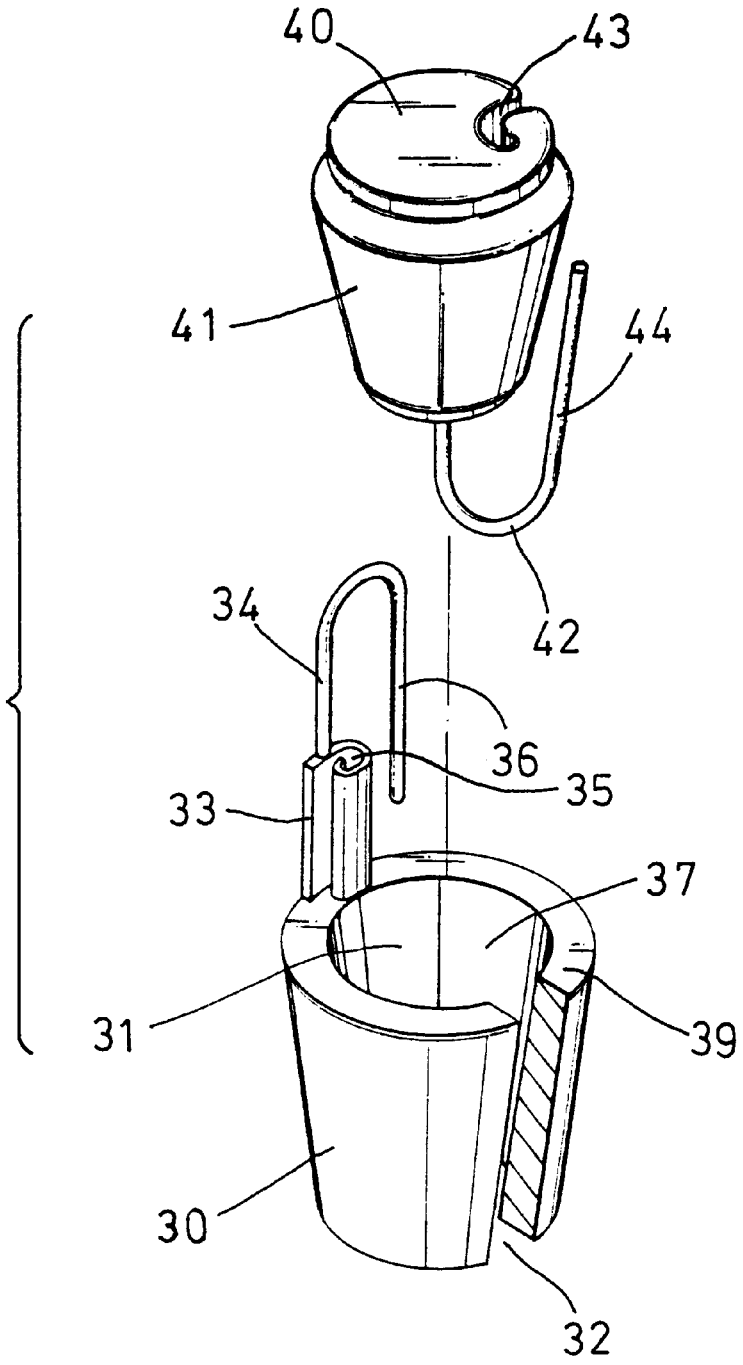
FIG. 5 is an exploded view similar to FIG. 4, illustrating another embodiment of the drapery hanger assembly.
Figure 6:
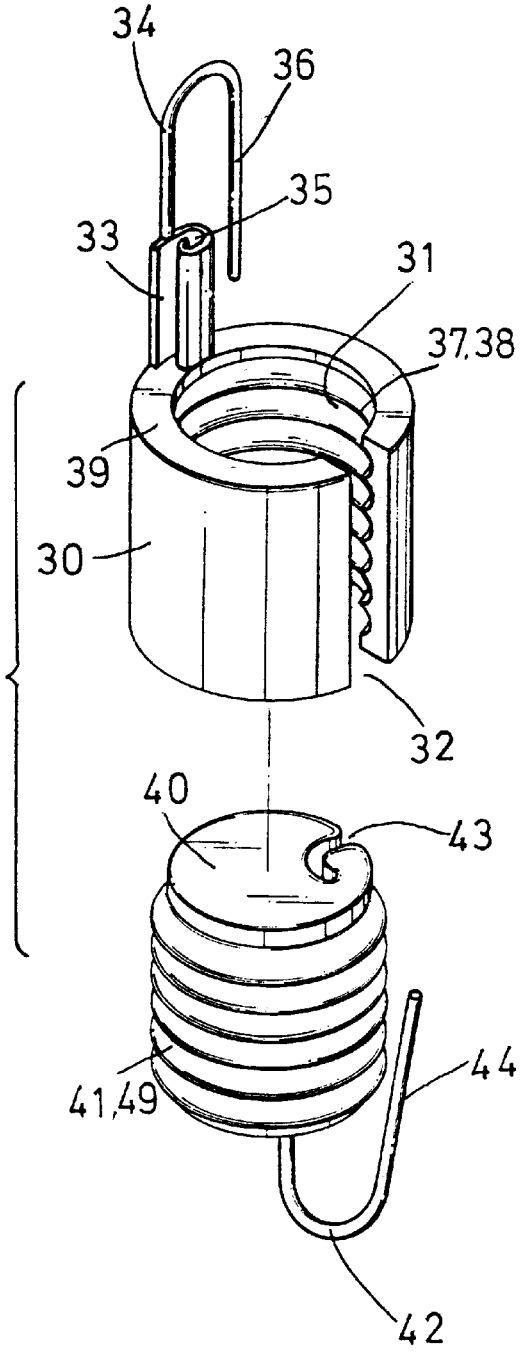
FIG. 6 is an exploded view similar to FIGS. 4 and 5, illustrating a further embodiment of the drapery hanger assembly.
Figure 7:
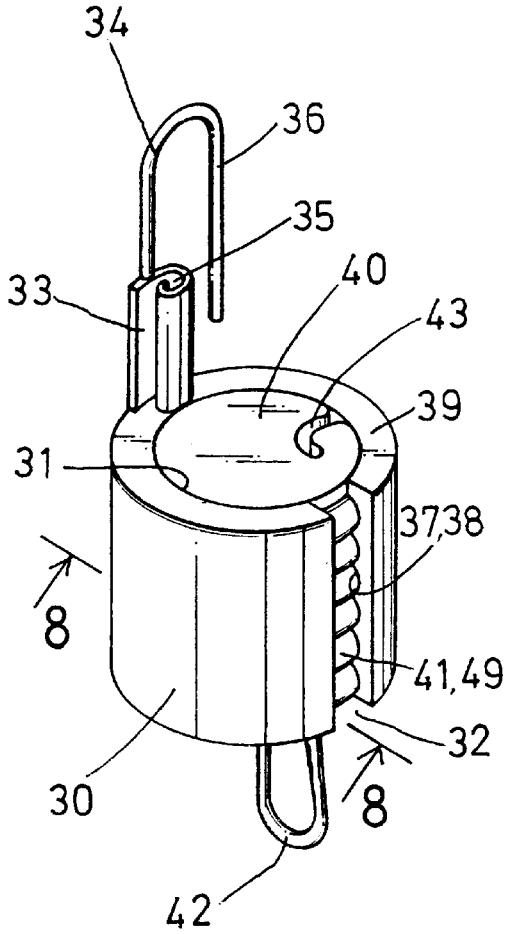
FIG. 7 is a perspective view of the drapery hanger assembly as shown in FIG. 6.
Figure 8:
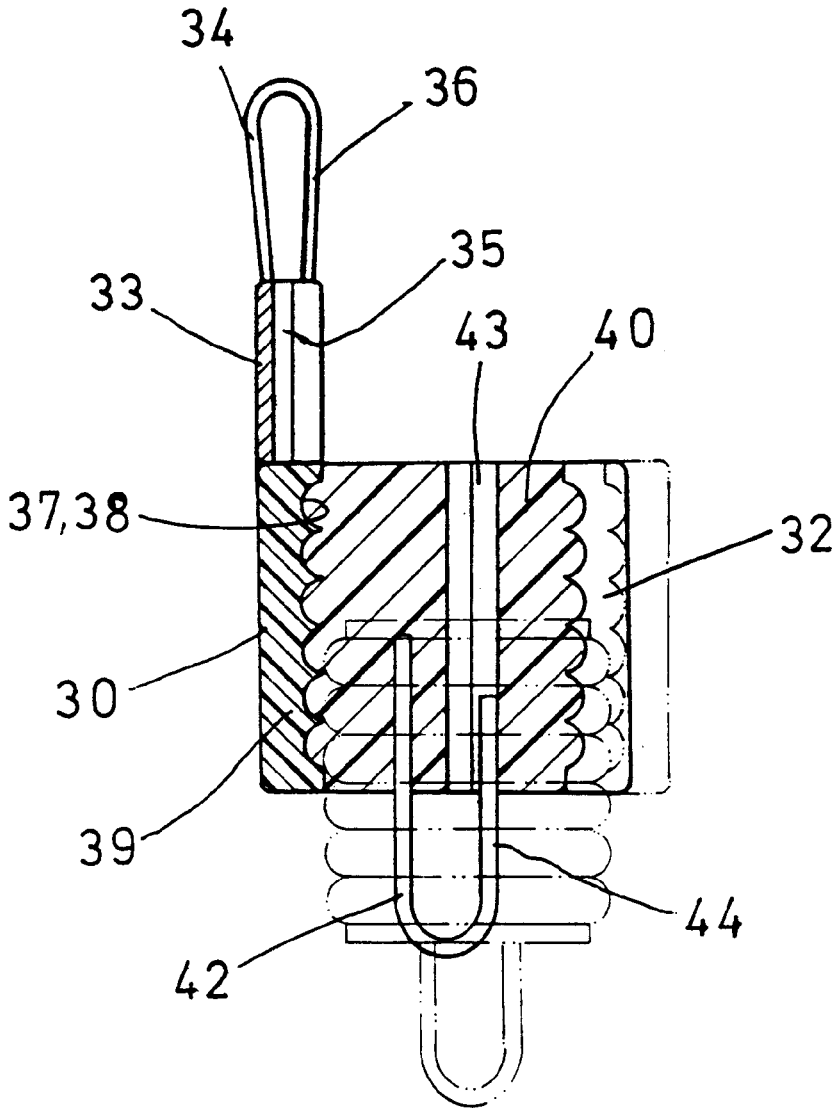
FIG. 8 is a cross sectional view taken along lines 8—8 of FIG. 7.

Referring next to FIG. 5, alternatively, without the inner thread 38 of the barrel 30 and without the outer thread 49 of the block 40, the block 40 may also be stably retained in the barrel 30 by the frustum-shaped or inclined inner peripheral surface 37 of the barrel 30 and the frustum-shaped or inclined outer peripheral surface 41 of the block 40. The block 40 may also be pulled and forced downward relative to the barrel 30 and quickly disengaged from the barrel 30 by the closure member 10.

Referring next to FIGS. 6–10, further alternatively, the barrel 30 and the block 40 may be formed into a cylindrical shape and including the inner and/or the outer peripheral surfaces 37, 41 having the cylindrical shape instead of the frustum-shape as shown in FIGS. 1–4. The block 40 may also be stably retained in the barrel 30 by the engagement of the inner thread 38 and the outer thread 49 of the barrel 30 and the block 40. The block 40 may also be pulled and forced downward relative to the barrel 30 and quickly disengaged from the barrel 30 by the closure member 10.

Accordingly, the drapery hanger assembly in accordance with the present invention includes one or more closure members detachable for emergency use.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A drapery hanger assembly comprising:

a track, at least one barrel attached to said track, a closure member, at least one block attached to said closure member, and means for detachably securing said at least one block to said at least one barrel, to disengage said at least one block away from said at least one barrel when said at least one block is forced and pulled away from said at least one barrel, said detachably securing means including a bore formed in said at least one barrel for detachably receiving said at least one block, and said detachably securing means including at least one peripheral recess provided in said at least one barrel and communicating with said bore of said at least one barrel, and includes at least one peripheral rib provided on said at least one block for engaging with said at least one peripheral recess of said at least one barrel and for detachably retaining said at least one block in said bore of said at least one barrel.

2. The drapery hanger assembly according to claim 1, wherein said detachably securing means includes an inclined inner peripheral surface provided in said at least one barrel for defining said bore of said at least one barrel, and includes an inclined outer peripheral surface provided on said at least one block for engaging with said inclined inner peripheral surface of said at least one barrel and for detachably retaining said at least one block in said bore of said at least one barrel.

3. The drapery hanger assembly according to claim 1, wherein said at least one barrel includes a peripheral wall and includes a longitudinal groove formed in said peripheral wall for allowing said peripheral wall of said at least one barrel to be expanded.

4. The drapery hanger assembly according to claim 1, wherein said at least one barrel includes a hook for attaching to said track.

5. The drapery hanger assembly according to claim 1, wherein said at least one barrel includes a seat provided thereon.and having said hook secured thereon, said seat includes a lock notch provided therein, said hook includes a finger detachably secured into said lock notch of said seat.

6. The drapery hanger assembly according to claim 4, wherein said track includes at least one sliding member slidably engaged therein and having a hook attached thereto for hooking to said hook of said at least one barrel.

7. The drapery hanger assembly according to claim 1, wherein said at least one block includes a hook for attaching to said track.

8. The drapery hanger assembly according to claim 7, wherein said at least one block includes a lock notch provided therein, said hook includes a finger detachably secured into said lock notch of said at least one block.

9. A drapery hanger assembly comprising:

a track, at least one barrel attached to said track, a closure member, at least one block attached to said closure member, and means for detachably securing said at least one block to said at least one barrel, to disengage said at least one block away from said at least one barrel when said at least one block is forced and pulled away from said at least one barrel, said detachably securing means including a bore formed in said at least one barrel for detachably receiving said at least one block, and said detachably securing means including at least one peripheral rib provided in said at least one barrel, and includes at least one peripheral recess provided in said at least one block for engaging with said at least one peripheral rib of said at least one barrel and for detachably retaining said at least one block in said bore of said at least one barrel.

10. A drapery hanger assembly comprising:

a track, at least one barrel attached to said track, a closure member, at least one block attached to said closure member, and means for detachably securing said at least one block to said at least one barrel, to disengage said at least one block away from said at least one barrel when said at least one block is forced and pulled away from said at least one barrel, said detachably securing means including a bore formed in said at least one barrel for detachably receiving said at least one block, and said detachably securing means including an inner thread provided in said at least one barrel, and includes an outer thread provided on said at least one block for engaging with said inner thread of said at least one barrel and for detachably retaining said at least one block in said bore of said at least one barrel.

* * * * *